US007846322B2

(12) United States Patent
Rice

(10) Patent No.: US 7,846,322 B2
(45) Date of Patent: Dec. 7, 2010

(54) INTEGRATED REFINERY WITH ENHANCED OLEFIN AND REFORMATE PRODUCTION

(75) Inventor: Lynn H. Rice, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 270 days.

(21) Appl. No.: 11/851,558

(22) Filed: Sep. 7, 2007

(65) Prior Publication Data

US 2010/0268010 A9 Oct. 21, 2010

Related U.S. Application Data

(63) Continuation of application No. PCT/US06/08808, filed on Mar. 10, 2006.

(60) Provisional application No. 60/661,176, filed on Mar. 11, 2005.

(51) Int. Cl.
*C07C 4/02* (2006.01)

(52) U.S. Cl. ..... 208/46; 208/130; 208/133; 585/648; 585/652; 585/818

(58) Field of Classification Search ..... 585/648, 585/652, 818; 208/130, 133
See application file for complete search history.

(56) References Cited

U.S. PATENT DOCUMENTS

| | | | | |
|---|---|---|---|---|
| 4,717,784 A | | 1/1988 | Stem et al. | 585/738 |
| 4,735,193 A | | 4/1988 | Kulprathipanja et al. | 127/46.3 |
| 4,740,219 A | | 4/1988 | Kulprathipanja et al. | 55/16 |
| 4,804,802 A | | 2/1989 | Evans et al. | 585/734 |
| 4,804,803 A | | 2/1989 | Schmidt et al. | 585/748 |
| 4,925,459 A | * | 5/1990 | Rojey et al. | 95/50 |
| 4,925,562 A | | 5/1990 | Te Hennepe et al. | 210/500.25 |
| 5,036,035 A | | 7/1991 | Baba et al. | 502/221 |
| 5,069,794 A | | 12/1991 | Haag et al. | 210/650 |
| 5,107,059 A | * | 4/1992 | Chen et al. | 585/818 |
| 5,127,925 A | | 7/1992 | Kulprathipanja et al. | 55/16 |
| 5,146,037 A | | 9/1992 | Zarchy et al. | 585/738 |
| 5,326,296 A | | 7/1994 | De Jesus | 441/60 |
| 5,705,730 A | | 1/1998 | Zarchy et al. | 585/738 |
| 5,922,639 A | | 7/1999 | Alario et al. | 502/230 |
| 5,968,366 A | | 10/1999 | Deckman et al. | 210/651 |

(Continued)

FOREIGN PATENT DOCUMENTS

EP 0 666 109 A1 1/1995

(Continued)

OTHER PUBLICATIONS

Separation of Normal Paraffins from Isoparaffins presented by I. A. Reddock, et al, at The Eleventh Australian Conference on Chemical Engineering, Brisbane, Sep. 4-7, 1983.

(Continued)

*Primary Examiner*—Robert J Hill, Jr.
*Assistant Examiner*—Brian McCaig
(74) *Attorney, Agent, or Firm*—Maryann Maas

(57) ABSTRACT

A high-flux membrane, especially a sieving membrane, is used to separate a naphtha feedstock into a retentate fraction having a reduced concentration of normal paraffins for an enhanced reforming feed and a permeate fraction having an increased concentration of normal paraffins for an enhanced cracking feed.

10 Claims, 1 Drawing Sheet

U.S. PATENT DOCUMENTS

| | | | | |
|---|---|---|---|---|
| 6,001,241 | A | 12/1999 | Gosling et al. | 208/65 |
| 6,013,173 | A | 1/2000 | Bogdan | 208/139 |
| 6,013,852 | A * | 1/2000 | Chandrasekharan et al. | 585/648 |
| 6,036,845 | A | 3/2000 | Funk et al. | 208/65 |
| 6,090,289 | A | 7/2000 | Verduijn et al. | 210/644 |
| 6,156,950 | A | 12/2000 | Ragil et al. | 585/802 |
| 6,214,764 | B1 | 4/2001 | Gillespie | 502/230 |
| 6,248,682 | B1 | 6/2001 | Thompson et al. | 502/4 |
| 6,338,791 | B1 | 1/2002 | Ragil et al. | 208/63 |
| 6,407,301 | B1 | 6/2002 | Foley et al. | 585/650 |
| 6,503,295 | B1 | 1/2003 | Koros et al. | 95/51 |
| 6,818,333 | B2 | 11/2004 | Chau et al. | 428/702 |
| 6,818,589 | B1 | 11/2004 | Gillespie | 502/326 |
| 2003/0196931 | A1 | 10/2003 | Houzvicka et al. | 208/65 |
| 2005/0283037 | A1 | 12/2005 | Briot et al. | 585/535 |

FOREIGN PATENT DOCUMENTS

| | | | |
|---|---|---|---|
| WO | WO 2005/012397 | A2 | 7/2004 |
| WO | WO 2005/049766 | A1 | 6/2005 |

OTHER PUBLICATIONS

McKeown, et al., Chem. Commun., 2780 (2002).
McKeown, et al.,, Chem. Eur. J., 11:2610 (2005).
Budd, et al., J. Mater. Chem., 13:2721 (2003).
Budd, et al., Adv. Mater., 16:456 (2004).
Budd, et al., Chem Commun., 230 (2004).

* cited by examiner

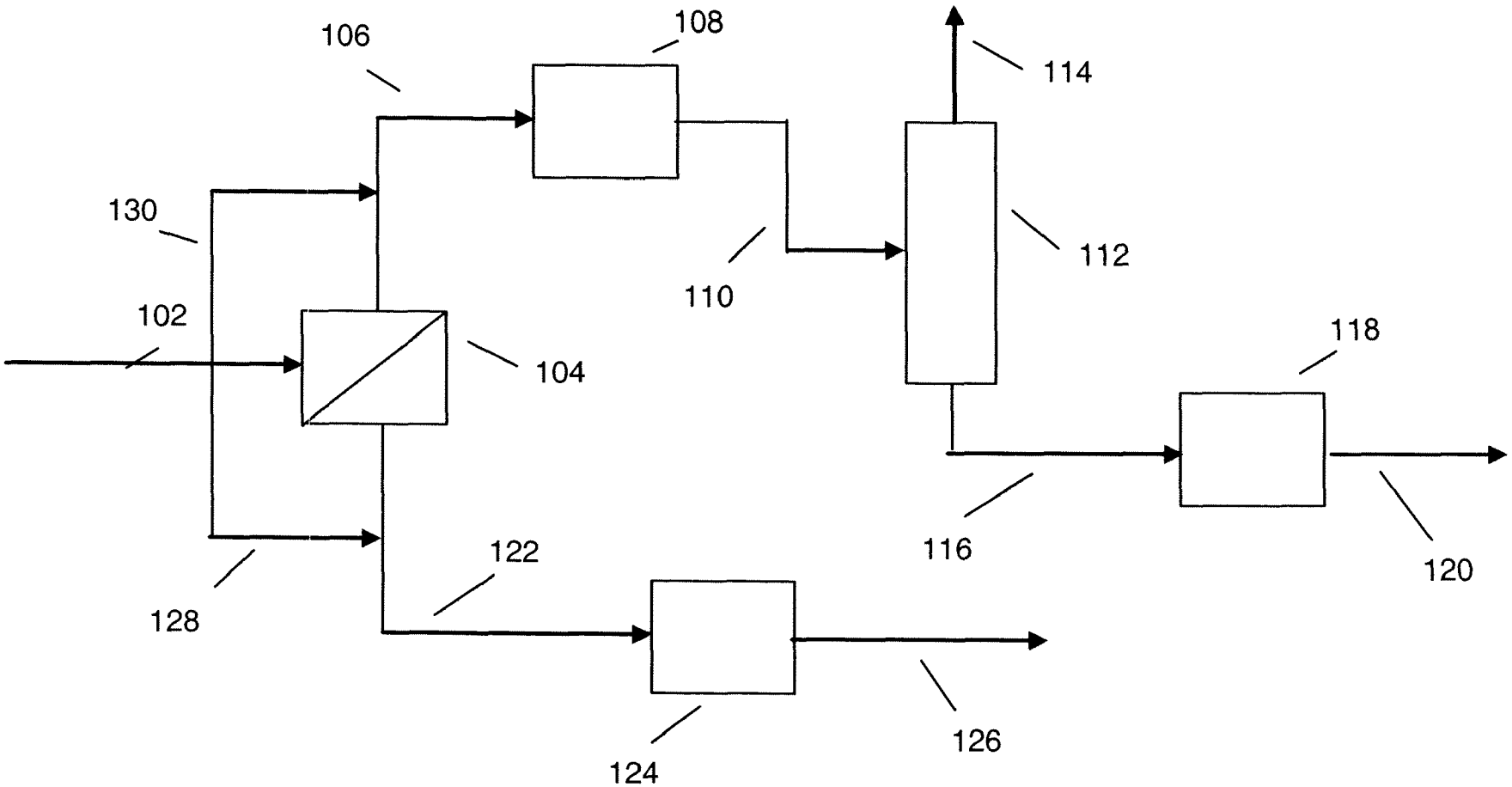
114
112
108
106
130
102
104
110
118
120
116
122
124
126
128

INTEGRATED REFINERY WITH ENHANCED OLEFIN AND REFORMATE PRODUCTION

BACKGROUND OF THE INVENTION

This invention pertains to apparatus and methods for providing an enhanced operation of a cracker and reformer using a naphtha feedstock using high-flux membranes to improve the composition of the feeds to each of the cracker and reformer. Full range naphtha feedstocks contain normal and non-normal paraffins. These feedstocks find numerous uses in petroleum refineries to produce useful petroleum and petrochemical products. One common use of naphtha feedstocks is as a feed to crackers, especially ethylene crackers, to produce olefins such as ethylene and propylene. Another utility is as a feed to a reformer to increase the octane rating of the naphtha such that it can be used in gasoline or to produce aromatics as chemical feedstocks.

Steam cracking, which is the thermal cracking of hydrocarbons in the presence of steam, is used commercially in large scale industrial units to produce ethylene and to a lesser extent propylene. These pyrolysis units are often charged a naphtha boiling range feed stream. The typical petroleum derived naphtha contains a wide variety of different hydrocarbon types including normal paraffins, branched paraffins, olefins, naphthenes, benzene, and alkyl aromatics. It is known in the art that paraffins are the most easily cracked and provide the highest yield of ethylene and that some compounds such as benzene are relatively refractory to the typical cracking conditions. It is also known that cracking normal paraffins results in a higher product yield than cracking isoparaffins. A paper entitled "Separation of Normal Paraffins from Isoparaffins" presented by I. A. Reddock, et al, at the Eleventh Australian Conference on Chemical Engineering, Brisbane, Sep. 4-7, 1983 discloses that the ethylene yield of a cracking unit can be increased if it is charged a $C_5$-$C_9$ stream of normal paraffins rather than a typical $C_5$-$C_9$ natural gasoline.

Adsorptive processes have been proposed to separate normal from non-normal paraffins in naphtha feedstocks. These processes usually use molecular sieves such as 5 A molecular sieve. See, for instance, U.S. Pat. No. 6,407,301. Not only do adsorptive separation processes require substantial capital but also many of the sorbents used have low tolerance for sulfur, nitrogen and oxygen-containing components. Thus, the entire naphtha stream must be subjected to pretreatment to remove deleterious components to the adsorptive separation. Alternatives to adsorptive separation are sought. However, due to the proximity of normal and non-normal boiling points of the components in a naphtha feedstock, distillation is not commercially practical.

U.S. Pat. No. 5,069,794 discloses microporous membranes containing crystalline molecular sieve material. At column 8, lines 11 et seq., potential applications of the membranes are disclosed including the separation of normal and branched paraffins. See also, U.S. Pat. No. 6,090,289, disclosing a layered composite containing molecular sieve that could be used as a membrane. Among the potential separations in which the membrane may be used that are disclosed commencing at column 13, line 6, include the separation of normal paraffins from branched paraffins. U.S. Pat. Nos. 6,156,950 and 6,338,791 discuss permeation separation techniques that may have application for the separation of normal paraffins from branched paraffins and describe certain separation schemes in connection with isomerization. US 2003/0196931 discloses a two-stage isomerization process for up-grading hydrocarbon feeds of 4 to 12 carbon atoms. The use of zeolite membranes is suggested as a suitable technique for separating normal molecules. See, for instance, paragraphs 0008 and 0032.

Although the use of membranes for the separation of normal from branched paraffins has been suggested, including in connection with certain isomerization processes, membranes have yet to find a practical, commercial application. Especially in a refinery involving large volumes of hydrocarbon feeds, extremely large membrane surface areas would have to be provided in order to achieve the sought separation of the normal paraffins. For instance, ZSM-5/Silicalite (MFI) membranes (a sieving membrane) available from NGK Insulators, Ltd., Japan, that have selectivity for the permeation of normal paraffins over branched paraffins, have a flux under operating conditions in the range of 0.1 to 1.0 milligram moles per second per square meter at a pressure differential of 15 to 500 kPa. U.S. Pat. No. 6,818,333 discloses thin zeolite membranes that are said to have a permeability of n-butane of at least $6\cdot10^{-7}$ mol/m$^2$ s·Pa and a selectivity of at least 250 of n-butane to isobutane. Bourney, et al., in WO 2005/049766 disclose a process for producing high octane gasoline using a membrane to remove, inter alia, n-pentane from an isomerized stream derived from the overhead of a deisohexanizer. In a computer simulation based upon the use of an MFI on alumina membrane, example 1 of the publication indicates that 5000 square meters of membrane surface area is required to remove 95 mass percent of n-pentane from the overhead from a deisohexanizer distillation column. At the flow rate of feed to the permeator (75000 kg/hr. having 20.6 mass percent n-pentane), the flux of n-pentane used in the simulation appears to be in the order of 0.01 gram moles/m$^2$·s at 300° C.

Thus, the costs for commercially implementing such membrane separation systems render them not competitive with respect to an adsorption separation system even if the entire naphtha stream were treated to remove contaminants potentially deleterious to the sorbent.

For the purposes of the following discussion of the invention, the following membrane properties are defined.

Microporous

Microporous and microporosity refer to pores having effective diameters of between 0.3 to 2 nanometers.

Mesoporous

Mesoporous and mesoporosity refer to pores having effective diameters of between 2 and 50 nanometers.

Macroporous

Macroporous and macroporosity refer to pores having effective diameters of greater than 50 nanometers.

Nanoparticle

Nanoparticles are particles having a major dimension up to 100 nanometers.

Molecular Sieves

Molecular sieves are materials having microporosity and may be amorphous, partially amorphous or crystalline and may be zeolitic, polymeric, metal, ceramic or carbon.

Sieving Membrane

Sieving membrane is a composite membrane containing a continuous or discontinuous selective separation medium containing molecular sieve barrier. A barrier is the structure that exists to selectively block fluid flow in the membrane. In a continuous sieving membrane, the molecular sieve itself forms a continuous layer that is sought to be defect-free. The continuous barrier may contain other materials such as would be the case with mixed matrix membranes. A discontinuous sieving membrane is a discontinuous assembly of molecular sieve barrier in which spaces, or voids, exist between particles or regions of molecular sieve. These spaces or voids may contain or be filled with other solid material. The particles or regions of molecular sieve are the barrier. The separation effected by sieving membranes may be on steric properties of the components to be separated. Other factors may also affect permeation. One is the sorptivity or lack thereof by a component and the material of the molecular sieve. Another is the interaction of components to be separated in the microporous structure of the molecular sieve. For instance, for some zeolitic molecular sieves, the presence of a molecule, say, n-hexane, in a pore, may hinder 2-methylpentane from entering that pore more than another n-hexane molecule. Hence, zeolites that would not appear to offer much selectivity for the separation of normal and branched paraffins solely from the standpoint of molecular size, may in practice provide greater selectivities of separation.

$C_6$ Permeate Flow Index

The permeability of a sieve membrane, i.e., the rate that a given component passes through a given thickness of the membrane, often varies with changes in conditions such as temperature and pressure, absolute and differential. Thus, for instance, a different permeation rate may be determined where the absolute pressure on the permeate side is 1000 kPa rather than that where that pressure is 5000 kPa, all other parameters, including pressure differential, being constant. Accordingly, a $C_6$ Permeate Flow Index is used herein for describing sieving membranes. The $C_6$ Permeate Flow Index for a given membrane is determined by measuring the rate (gram moles per second) at which a substantially pure normal hexane (preferably at least 95 wt-% normal hexane) permeates the membrane at approximately 150° C. at a retentate side pressure of 1000 kPa absolute and a permeate-side pressure of 100 kPa absolute. The $C_6$ Permeate Flow Index reflects the permeation rate per square meter of retentate-side surface area but is not normalized to membrane thickness. Hence, the $C_6$ Permeate Flow Index for a given membrane will be in the units of gram moles of normal hexane permeating per second per square meter of retentate-side membrane surface area.

$C_6$ Permeate Flow Ratio

The $C_6$ Permeate Flow Ratio for a given sieve membrane is the ratio of the $C_6$ Permeate Flow Index to an i-$C_6$ Permeate Flow Index wherein the i-$C_6$ Permeate Flow Index is determined in the same manner as the $C_6$ Permeate Flow Index but using substantially pure dimethylbutanes (regardless of distribution between 2,2-di-ethylbutane and 2,3-dimethylbutane) (preferably at least 95 mass-% dimethylbutanes).

SUMMARY OF THE INVENTION

By this invention, economically viable integrated apparatus for cracking and reforming naphtha feedstocks and processes for operating the apparatus can be provided by using high-flux, selectively permeable membranes to treat the feedstock. A retentate fraction (106) that has a lower concentration of normal paraffins than does the feedstock (102, 128, 130) is obtained by a membrane separation and is used as a feed for the reformer (118). A permeate fraction (122) that is richer in normal paraffins is obtained from the separation and is used as a feed to a steam cracker (124) to produce olefins (126). In accordance with this invention, it has been found that the selectively permeable membrane need not be very selective for the permeation of normal paraffins as compared to non-linear paraffins to provide an enhancement in the operation of each of an integrated cracker (124) and a reformer (118). Hence, attractive sieve membranes can be selected on the basis of permeation rate even at a substantial sacrifice in selectivity. The preferred membranes are sieving membranes.

In accordance with the broad aspects of the apparatus of the invention, an integrated naphtha cracker (124) and naphtha reformer (118) system comprises: (a) a naphtha supply conduit (102), (128), (130) adapted to supply naphtha; (b) a membrane separator (104) having at least one inlet and containing a selectively permeable membrane, preferably a sieving membrane, having a permeate side and a retentate side, said membrane having a $C_6$ Permeate Flow Index of at least 0.01 and a $C_6$ Permeate Flow Ratio of at least 1.25:1, said membrane separator adapted to provide a permeate (122) on the permeate side that is enriched in normal paraffins as compared to naphtha; (c) a steam cracker (124) adapted to produce olefin (126) in fluid communication with the permeate side of the sieving membrane in separator (104); and (d) a naphtha reformer (118) adapted to provide a reformate (120) in fluid communication with the retentate side (106) of the sieving membrane in separator (104).

In a preferred embodiment of the apparatus of the invention, intermediate and in fluid flow communication with the membrane separator (104) and the reformer (118) is hydrotreater (108), (110), (112) adapted to remove sulfur components (114) and provide stream (116).

The processes for converting naphtha feedstock containing normal and non-normal paraffins to olefins and reformate comprise in their broad aspects: (a) contacting at said feedstock with a retentate-side of a selectively permeable membrane, preferably a sieving membrane, having a $C_6$ Permeate Flow Index of at least 0.01 and a $C_6$ Permeate Flow Ratio of at least 1.25:1 under conditions including sufficient membrane surface area and pressure differential across the membrane to provide a retentate fraction that has a reduced concentration of normal paraffins, and to provide across the membrane at a permeate-side, a permeate fraction having an increased concentration of normal paraffins; (b) cracking at least a portion of the permeate fraction under cracking conditions to provide an olefin-containing cracker product; and (c) reforming at least a portion of the retentate fraction under reforming conditions to provide an aromatic-containing reformate.

In the preferred processes of the invention, the naphtha feedstock contains sulfur component and the retentate fraction is subjected to hydrotreating under hydrotreating conditions to remove sulfur component therefrom prior to reforming. In some aspects of the processes of the invention, the sulfur component permeates the membrane and the concentration of sulfur component in the permeate fraction is greater than the concentration of sulfur component in the retentate fraction.

DESCRIPTION OF THE FIGURE

The FIGURE is a schematic representation of an integrated cracker and refining system in accordance with this invention.

DETAILED DISCUSSION

The great bulk of the ethylene consumed in the production of various plastics and petrochemicals such as polyethylene is produced by the thermal cracking of higher molecular weight hydrocarbons. Steam is usually admixed with the feed stream to the cracking reactor to reduce the hydrocarbon partial pressure and enhance olefin yield and to reduce the formation and deposition of carbonaceous material in the cracking reactors. The process is therefore often referred to a steam cracking or pyrolysis. Naphtha boiling point range feedstocks can also be used to provide gasoline and aromatics. In these processes, the feed stream is contacted with a catalyst at elevated temperatures. As used herein, these processes are referred to as reforming processes regardless of whether the objective is to enhance octane rating of a feed stream or to synthesize aromatic compounds.

The feedstreams suitable for use in the processes of this invention can be quite diverse and can be chosen from a variety of petroleum fractions, especially those fractions falling within the naphtha boiling point range, e.g., 36° to 195° C. Generally, these streams comprise hydrocarbons of $C_5$ to $C_{11}$, preferably of $C_5$ or $C_6$ to $C_{10}$. For steam cracking, it is generally preferred that the feedstream contain little $C_5$. Preferably the feed steam does not contain appreciable amounts, e.g. more than 5 mol-%, of $C_{12}$ hydrocarbons. A representative feed stream to the subject process is a $C_5$-$C_{11}$ fraction produced by fractional distillation of a petroleum fraction. Another representative feed is a similar fraction comprising $C_5$ through $C_9$ hydrocarbons. The feed will preferably have a carbon number range of at least three.

The feedstream may be subjected to various treatments to remove sulfur, oxygenated and nitrogen-containing components. For instance, the feed stream may be hydrotreated or otherwise processed to remove sulfur components. However, a particularly attractive aspect of the processes of this invention is that only that fraction of the feedstream passed to the reformer need be subjected to hydrotreating.

With reference to the FIGURE, a naphtha feedstock is passed via line 102 to membrane separator 104 where the feedstock is contacted with the retentate side of a membrane to provide a retentate fraction that has a reduced concentration of normal paraffins, and to provide across the membrane at a permeate-side, a permeate fraction having an increased concentration of normal paraffins. In the preferred aspects of the invention, the permeate fraction contains at least 75 mass-% of the normal paraffins in the naphtha feedstock.

A pressure drop is maintained across the membrane in order to effect the desired separation at suitable permeation rates. The membrane has a $C_6$ Permeate Flow Index of at least 0.01, more preferably at least 0.02, and a $C_6$ Permeate Flow Ratio of at least 1.25:1, more preferably at least 1.3:1, and often 1.35:1 to 5:1 or 6:1. The membrane may be any suitable type, but preferably is a sieving membrane. Often, the pressure drop is in the range of 0.1 to 10, preferably 0.2 to 2, mPa. The temperature for the membrane separation will depend in part on the nature of the membrane and on the temperature naphtha feedstock. Thus, for polymer-containing membranes, temperatures should be sufficiently low that the strength of the membrane is not unduly adversely affected. In most instances, the temperature for the separation is the temperature of the isomerization effluent. Often the temperature is in the range of 25° C. to 150° C. or 200° C. Thus, the conditions of the membrane separation may provide for a liquid or gas or mixed phase on the retentate side of the membrane. Regardless of the phase of the fluid on the retentate side, the permeate may be a gas. If the fluid on the retentate side of the membrane is in the liquid phase, the permeate may be liquid, gaseous or mixed phase.

The membranes may be in any suitable form such as hollow fibers; sheet, and the like which can be assembled in a separator unit such as bundled hollow fibers or flat plate or spiral wound sheet membranes. The physical design of the membranes should enable, when assembled in the separator unit, sufficient pressure drop across the membrane to provide desirable flux. For hollow fiber membranes, the high pressure side (retentate side) is usually at the outside of the hollow fiber. The flow of the permeate may be co-current, counter-current or cross-current with respect to the flow of the fluid on the retentate side of the membrane.

Sufficient membrane surface area is provided that under steady state conditions at least 75, preferably at least 80, and more preferably at least 90, mass-% of the normal paraffins in the isomerization effluent are contained in the permeate. The concentration of the normal paraffins in the permeate will depend upon the selectivity of the membrane. While the membrane may be highly selective and provide a permeate containing 99 mass-% or more of normal paraffins, advantageous embodiments of this invention can be achieved with lesser purity permeates. The concentration of normal paraffin to the permeate in these embodiments will be less than 90 mass-%, e.g., from 25 to 90, say, 40 to 80, mass-%. The remainder of the effluent will typically be branched and cyclic compounds contained in the naphtha feedstock.

Any suitable selectively permeable membrane may be used in the apparatus and processes of this invention. The preferred membranes are sieving membranes. The membranes used in the processes of this invention are characterized in having high flux, i.e., having a $C_6$ Permeate Flow Index of at least 0.01.

The preferred sieving membranes may be of various types, for instance, molecular sieves, pore-containing ceramic, metal, polymeric or carbon membranes, or composite membranes having a highly porous polymeric, metallic, molecular sieve, ceramic or carbon support with a thin sieving layer or barrier (molecular sieve), e.g., zeolitic, polymeric, metal, ceramic or carbon, having microporosity.

The membranes may be continuous or discontinuous. A discontinuous membrane comprises an assembly of small particle size microporous barrier whereas a continuous membrane comprises a continuous layer of microporous barrier. The membranes may be formed of a single material or they may be composites containing microporous barrier and support and, optionally, other structure. When making a thin, continuous barrier layer, as the thickness of the sieving layer decreases, the difficulties in obtaining a defect-free layer increase. As the processes of this invention do not require high selectivity, the membranes can contain minor defects. Typically continuous membranes are made by depositing or growing on a meso/macroporous structure, a continuous, thin layer of microporous barrier. Discontinuous assemblies of nano-sized microporous barrier enable very small permeating thicknesses to be achieved, but with the potential of by-pass. Discontinuous membranes use a meso/macroporous structure with which the microporous barrier is associated.

Examples of zeolite barrier include small pore molecular sieves such as SAPO-34, DDR, AlPO-14, AlPO-17, AlPO-18, AlPO-34, SSZ-62, SSZ-13, zeolite 3A, zeolite 4A, zeolite 5A, zeolite KFI, H-ZK-5, LTA, UZM-9, UZM-13, ERS-12, CDS-1, Phillipsite, MCM-65, and MCM-47; medium pore molecular sieves such as silicalite, SAPO-31, MFI, BEA, and MEL; large pore molecular sieves such as FAU, OFF, NaX, NaY, CaY, 13X, and zeolite L; and mesoporous molecular sieves such as MCM-41 and SBA-15. A number of types of molecular sieves are available in colloidal (nano-sized particle) form such as A, X, L, OFF, WI, and SAPO-34. The zeolites may or may not be metal exchanged.

Other types of sieving materials include carbon sieves; polymers such as PIMs (polymers of intrinsic microporosity) such as disclosed by McKeown, et al., Chem. Commun., 2780 (2002); McKeown, et al., Chem. Eur. J., 11:2610 (2005); Budd, et al., J. Mater. Chem., 13:2721 (2003); Budd, et al., Adv. Mater., 16:456 (2004) and Budd, et al., Chem Commun., 230 (2004); polymers in which porosity is induced by pore-forming agents such as poly(alkylene oxide), polyvinylpyrrolidone; cyclic organic hosts such as cyclodextrins, calixarenes, crown ethers, and spherands; microporous metal-organic frameworks such as MOF-5 (or IRMOF-1); glass, ceramic and metal shapes into which microporosity has been introduced.

In composite membranes, a meso/macroporous structure is used. The meso/macroporous structure serves one or more functions depending upon the type membrane. It can be the support for the membrane composite, it can be an integral part of forming the microporous barrier, it can be the structure upon which or in which the microporous barrier is located. The meso/macroporous structure can be continuous or discontinuous, and the meso/macroporosity may thus be channels through the material of the meso/macroporous structure or be formed between particles that form the meso/macroporous structure. Examples of the latter are the AccuSep™ inorganic filtration membranes available from the Pall Corp. having a zirconia layer on a porous metal support wherein the zirconia is in the form of spherical crystals.

The meso/macroporous structure preferably defines channels, or pores, in the range of 2 to 500, preferably, 10 to 250, more preferably between 20 and 200, nanometers in diameter, and has a high flux. In more preferred embodiments, the $C_6$ Permeant Flow Index of the meso/macroporous structure is at least 1, and most preferably at least 10, and sometimes at least 1000. The meso/macroporous structure may be isotropic or anisotropic. The meso/macropores may be relatively straight or tortuous.

The meso/macroporous structure may be composed of inorganic, organic or mixed inorganic and organic material. The selection of the material will depend upon the conditions of the separation as well as the type of meso/macroporous structure formed. The material of the meso/macroporous structure may be the same or different than the material for the molecular sieve. Examples of porous structure compositions include metal, alumina such as alpha-alumina, gamma alumina and transition aluminas, molecular sieve, ceramics, glass, polymer, and carbon. In preferred embodiments, defects in the substrate are repaired prior to providing the barrier or precursor to the barrier. In another embodiment, the substrate may be treated with a silica sol to partially occlude pores and facilitate deposition of the barrier or precursor to the barrier. The silica particles will still provide sufficient space between their interstices to allow high flux rates. Another technique is to coat the support with silicon rubber or other polymer that permits high flux but occludes defects in the support or in the barrier.

If the meso/macroporous structure does not so serve, the membrane can contain a porous support for the meso/macroporous structure. The porous support is typically selected on the basis of strength, tolerance for the conditions of the intended separation and porosity.

The AccuSep™ inorganic filtration membranes available from Pall Corp. and similar types of meso/macroporous structures are particularly advantageous since the meso/macroporous structure can be thin thereby avoiding undue thicknesses of molecular sieve being grown. Further, the zirconia is relatively inert to zeolite-forming precursor solutions and synthesis and calcination conditions, making it a preferred meso/macroporous structure for these types of sieving membrane.

High flux is achieved through at least one of the following techniques: first, using a larger pore than required for normal alkane to pass; and second, using an extremely thin pore-containing layer. Where high flux is achieved using larger, less selective micropores in the microporous barrier, adequate separation may be achieved. Often the pores for these types of membranes have an average pore diameter of greater than 5.0 Å (average of length and width), says 5.0 to 7.0 or 8 Å. Preferably the structures have an aspect ratio (length to width) of less than 1.25:1, e.g., 1.2:1 to 1:1. For molecular sieve-containing membranes, exemplary structures are USY, ZSM-12, SSZ-35, SSZ-44, VPI-8, and Cancrinite. In some instances, a permeating molecule in a micropore may assist in enhancing selectivity. For instance, a normal hydrocarbon in a pore may decrease the rate at which a branched hydrocarbon can enter the pore as compared to another normal hydrocarbon.

High flux can also be achieved using very thin microporous barrier in either a continuous or discontinuous membrane. The microporous barrier can, if desired, be selected from sieving structures having micropores that are substantially impermeable to the moiety sought to be retained on the retentate side. In general, the pores for these types of membranes have an average pore diameter of up to 5.5 Å, for instance, 4.5 to 5.4 Å. The aspect ratio of the pores of these membranes may vary widely, and is usually in the range of 1.5:1 to 1:1. For molecular sieve-containing membranes, exemplary structures are ZSM-5, silicalite, ALPO-11, ALPO-31, ferrierite, ZSM-11, ZSM-57, ZSM-23, MCM-22, NU-87, UZM-9, and CaA.

Membranes comprising a discontinuous assembly of microporous barrier are characterized in that the barrier has a major dimension less than 100 nanometers, and the microporous barrier is associated with a meso/macroporous structure defining fluid flow pores, wherein barrier is positioned to hinder fluid flow through the pores of the meso/macroporous structure. A molecular sieve barrier is "associated" with a meso/macroporous structure when it is positioned on or in the structure whether or not bonded to the structure. Hence, nano-sized particles or islands of molecular sieve are used as barriers for the membranes. The discontinuous, microporous barrier is positioned to hinder fluid flow through fluid flow channels defined by the meso/macroporous structure. The barrier may be at least partially occluding the opening of a fluid flow channel of the meso/macroporous structure and/or within the fluid flow channel. Due to the small size of the particles or islands forming the discontinuous assembly of microporous barrier, some selectivity of separation is achievable despite the discontinuity.

Typically the size and configuration of the molecular sieve particles and the size and configuration of the meso/macropores in the meso/macroporous structure will be taken into account in selecting the components for the sieving membranes. With more spherical molecular sieve particles, such as silicalite, it is preferred to select a meso/macroporous structure having pores that are close to the same effective diameter. In this manner, the molecular sieve particles, if placed in, or partially in, the pores of the meso/macroporous structure, will provide minimal void space for by-pass. More flexibility exists with platelets and irregular shaped molecular sieve particles as they can overlap with little or no void space. In some instances a combination of molecular sieve configurations may be desirable. For instance, a spherical molecular sieve may be drawn into the pores of a meso/macroporous structure with smaller, more plate-like molecular sieve particles being subsequently introduced. The complementary functions are that the sphere serves as a support for the plate-like particles and the plate-like particles overlap to reduce by-pass. While the molecular sieves will likely be different compositions, and thus have different microporosity size and configuration, the benefit is enhanced separation without undue loss of permeance.

Where zeolitic molecular sieves are used, obtaining small particles is important to obtaining the high flux in a discontinuous microporous barrier. For many zeolites, seed particles are available that are less than 100 nanometers in major dimension. Most molecular sieves are made using organic templates that must be removed to provide access to the cages. Typically this removal is done by calcination. As discussed later, the calcination may be effected when the template-containing molecular sieves are positioned in a macropore such that undue agglomeration is avoided simply by limiting the number of particles that are proximate. Another technique for avoiding agglomeration of the zeolite particles during calcination is to silate the surface of the zeolite, e.g., with an aminoalkyltrialkoxysilane, aminoalkylalkyldialkoxysilane, or aminoalkyldialkylalkoxysilane. The amount of silation required will depend upon the size of the zeolite and its composition as well as the conditions to be used for calcination. In general, between 0.1 to 10 millimoles of silane are used per gram of zeolite.

Various techniques exist for providing the molecular sieve particles on or in the meso/macroporous support in a manner that at least partially occludes the meso- or macropores in the support. The specific technique to be used will depend upon the size and configuration of the molecular sieve particles, the size and configuration of the meso/macropores in the meso/macroporous structure, and the desired placement of the molecular sieve in or on the meso/microporous structure.

Especially where molecular sieve is placed on the surface of a meso/macroporous structure to occlude at least a portion of the opening of the pores, the meso/macroporous structure may be wet with a solution, or suspension, of nano-sized molecular sieve. The concentration of molecular sieve in the suspension should be sufficiently low that upon drying, the resulting layer of molecular sieve is not unduly thick. Advantageously at least a slight pressure drop is maintained across the meso/macroporous structure during the coating such that a driving force will exist to draw molecular sieve to any pores in the meso/macroporous structure that have not been occluded. Usually the suspension will be an aqueous suspension, although suspensions in alcohols and other relatively inert liquids can be used advantageously, at a concentration of between 2 and 30, say 5 and 20, mass percent. Where a pressure differential is used, the pressure differential is generally in the range of 10 to 200 kPa. One or more coats of molecular sieve may be used, preferably with drying between coats. Drying is usually at an elevated temperature, e.g., between 30° C. and 150° C., for 1 to 50 hours. Vacuum may be used to assist drying. Where zeolites are used as the molecular sieve, calcining, e.g., at a temperature of between 450° C. and 600° C. may, in some instances, assist in securing the molecular sieve to the meso/macroporous structure. Calcining may also serve to agglomerate the molecular sieve particles and thus reduce voids and the size of voids. Calcining, of course, is not essential to the broad aspects of this invention and is only required where, for example, template resides in the micropores.

Where the discontinuous assembly of nano-sized molecular sieve is located outside the pores of the meso/macroporous structure, it may be desirable to bond at least a portion of the particles to the surface of the structure. This can be accomplished in a number of ways. For instance, the surface of the structure can be functionalized with hydroxyl groups or other moieties that would be reactive with a zeolitic molecular sieve. For polymeric molecular sieves, the surface may be functionalized with moieties that react, such as addition or condensation, with functional moieties on the polymer. These techniques are well known in the art for other applications.

Similar preparation techniques can be used where it is desired to incorporate at least a portion of the molecular sieve particles in the pores of the meso/macroporous structure. The molecular sieve particles should be of an appropriate size to enter the meso/macropores. A pressure differential may be used to draw barrier particles into the pores or ultrasonication may be used to aid in getting barrier particles into the pores of the meso/macroporous support. The depth of the molecular sieve particles in the pores of the meso/macroporous structure should not be so great as to unduly reduce permeance. Often, any surface deposition of molecular sieve is removed by, e.g., washing.

If desired, zeolitic molecular sieves can be grown in situ in the pores of the meso/macroporous structure to provide a discontinuous membrane. The synthesis may provide discrete particles or islands between other structure such as the meso/macroporous structure or other particles.

An example of using other particles to make discontinuous membranes of zeolitic molecular sieves, involves providing silica, which may have a particle size of between 5 and 20 nanometers, in or on the meso/macroporous structure. The silica, due to the active hydroxyls on the surface, serves as a nucleating site for a zeolite-forming, precursor solution, and layers of zeolite can be grown on and between the silica particles.

Materials other than silica particles can be used as nucleating sites including other molecular sieves or seed crystals of the same zeolite. The surface of the meso/macroporous structure can be functionalized to provide a selective location for zeolite growth. Some zeolites have self nucleating properties and thus may be used in the absence of nucleating sites. Examples of these zeolites are FAU and MFI. In these situations, it may be desired to maintain the precursor solution under zeolite forming conditions for a time sufficient that growth of the zeolite starts prior to contacting the precursor solution with the meso/macroporous structure.

For example, one method to form a barrier layer is to place a zeolitic molecular sieve precursor liquid on a meso/microporous structure. The precursor is permitted to crystallize under hydrothermal crystallization conditions, after which the membrane is washed and heated to remove residual organic material. The molecular sieve material resides primarily in and occludes the pores of the porous substrate.

The molecular sieve may be of any suitable combination of elements to provide the sought pore structure. Aluminum, silicon, boron, gallium, tin, titanium, germanium, phosphorus and oxygen have been used as building blocks for molecular sieves such as silica-alumina molecular sieves, including zeolites; silicalite; AlPO; SAPO; and boro-silicates. The precursor includes the aforementioned elements, usually as oxides or phosphates, together with water and an organic structuring agent which is normally a polar organic compound such as tetrapropyl ammonium hydroxide. Other adjuvants may also be used such as amines, ethers and alcohols. The mass ratio of the polar organic compound to the building block materials is generally in the range of 0.1 to 0.5 and will depend upon the specific building blocks used. In order to prepare thin layers of molecular sieves in the membranes, it is generally preferred that the precursor solution be water rich. For instance, for silica-alumina molecular sieves, the more ratio of water to silica should be at least 20:1 and for aluminophosphate molecular sieves, the mole ratio should be at least 20 moles of water per mole of aluminum.

The crystallization conditions are often in the range of 80° C. to 250° C. at pressures in the range of 100 to 1000, frequently 200 to 500, kPa absolute. The time for the crystallization is limited so as not to form an unduly thick layer of molecular sieve. In general, the crystallization time is less than 50, say, 10 to 40, hours. Preferably the time is sufficient to form crystals but less than that required to form a molecular sieve layer of 200 nanometers, say, 5 to 50 nanometers. The crystallization may be done in an autoclave. In some instances, microwave heating will effect crystallization in a shorter period of time. The membrane is then washed with water and then calcined at 350° to 550° C. to remove any organics.

Especially with some zeolitic molecular sieve materials, making particles less than 100 nanometers is troublesome. Moreover, even with the use of seed crystals, the particle size may be larger than desired. Another embodiment in making a discontinuous barrier membrane is to synthesize the zeolite in open regions between particles (substrate particles) having a major dimension less than 100 nanometers. Accordingly, the major dimension of the microporous barrier can be less than 100 nanometers. The substrate particles serve as a nucleating site for the zeolite formation and thus are selected from materials having capability of nucleating the growth of the zeolite. Examples of such materials are silica, especially silica having a major dimension of between 5 and 50 nanometers and other zeolites having major dimensions less than 100 nanometers. The use of fumed silica as the substrate particle is particularly useful for making an AlPO microporous barrier.

The growth of the zeolite on the substrate particle may occur before or after the substrate particle is used in forming the membrane composite.

Advantageously, the growth of the zeolite on the substrate particles occurs while drawing the synthesis liquor through the composite. This technique helps ensure that the growth occurs not as a layer on top of the particles, but in the interstices between the particles. The pressure drop increases as the zeolite growth occurs, and the pressure drop can be used as an indicator when adequate zeolite formation has occurred.

Polymeric molecular sieves can be synthesized in the meso/macroporous structure. One method for synthesizing a small polymeric molecular sieve is to functionalize nanoparticles and/or the meso/macroporous structure with a group that can react with an oligomer such as through a condensation or addition reaction. For instance, the functional groups may provide a hydroxyl, amino, anhydride, dianhydride, aldehyde, amic acid, carboxyl, amide, nitrile, or olefinic moiety for addition or condensation reaction with a reactive moiety of an oligomer. Suitable oligomers may have molecular weights of 30,000 to 500,000 or more and may be reactive oligomers of polysulfones; poly(styrenes) including styrene-containing copolymers; cellulosic polymers and copolymers; polyamides; polyimides; polyethers; polyurethanes; polyesters; acrylic and methacrylic polymers and copolymers; polysulfides, polyolefins, especially vinyl polymers and copolymers; polyallyls; poly(benzimidazole); polyphosphazines; polyhydrazides; polycarbodiides, and the like.

The synthesis in situ of the molecular sieve, whether it be inorganic or organic, can be under suitable conditions. A preferred technique involves conducting the synthesis while drawing the reactant solution, e.g., the precursor solution or oligomer solution through the meso/macroporous structure. This technique provides the benefit of directing the reactant solution to voids that have not been occluded as well as limits the extent of growth of the molecular sieve as no fresh reactant will be able to enter the reaction site once the molecular sieve has occluded the meso- or macropore.

The molecular sieve on polymer support membranes or polymeric supports themselves may also be pyrolyzed in a vacuum furnace to produce a carbon membrane. For such membranes containing molecular sieves, the pore structure of the carbon support is preferably of sufficient diameter to minimize the resistance to the flow of fluids with the molecular sieve structure doing the separation. The temperature of the pyrolysis will depend upon the nature of the polymer support and will be below a temperature at which the porosity is unduly reduced. Examples of polymeric supports include polyimides, polyacrylonitrile, polycarbonates, polyetherketones, polyethersulfones and polysulfones, and prior to pyrolysis, the supports have pores or openings in the range of 2 to 100, preferably 20 to 50, nanometers.

Continuous membranes may be prepared by any suitable technique. Typically, the thickness of the microporous barrier will be related to the duration of the deposition or growth of the microporous barrier on the meso/macroporous structure. The microporous barrier may be formed by reducing the pore size of an ultrafiltration membrane (effective pore diameters of 1 to 100 nanometers) or a microfiltration membrane (effective pore diameters of 100 to 10,000 nanometers) by, e.g., organic or inorganic coating of the channel either interior of the surface, or preferably, at least partially proximate to the opening of the channel. The deposited material serves to provide a localized reduction of the pores or openings through the support to a size which permits the desired sieving without unduly reducing the diameter of the remaining pore structure in the support. Examples of vapor depositable materials include silanes, paraxylylene, alkylene imines, and alkylene oxides. Another technique for reducing pore size is to deposit a coke layer on the meso/macroporous structure. For instance, a carbonizable gas such as methane, ethane, ethylene or acetylene can be contacted with the structure at sufficiently elevated temperature to cause coking. The preferred porous supports are ultrafiltration membranes having pore sizes of between 1 and 80, preferably between 2 and 50, nanometers.

For zeolitic, continuous membranes, one fabricating technique involves contacting the surface of the meso/macroporous structure with precursor for molecular sieve and growing the molecular sieve for a time sufficient to achieve the sough film thickness. The procedures disclosed above can be used to synthesize the molecular sieve. In some instances, it may be desirable to occlude, e.g., with a wax, the meso/macropores of the support to prevent undue growth of zeolite in those pores. The wax can subsequently be removed.

Various techniques are available to enhance the selectivity of high flux membranes. Numerous techniques exist to cure defects in continuous or discontinuous membranes. As the membranes need not exhibit high $C_6$ Permeate Flow Ratios to be useful for many applications, any technique that increases resistance to flow through the defects will serve to improve membrane performance. For instance, a silica sol overlay coating may be used to occlude interstitial openings between the molecular sieve crystals or remaining large pores in the support regardless of how the membrane is prepared.

Another technique to occlude large pores is to provide on one side of the barrier layer a large, reactive molecule which is not able to permeate the micropores of the barrier and on the other side a cross linking agent. The major defects, and to some extent the minor defects become filled with the large, reactive molecule and are fixed by crosslinking. The unreacted large molecule component can then be removed as well as unreacted crosslinking agent. The large molecule may be an oligomer or large molecule.

For discontinuous membranes, solid may be provided in at least a portion of the voids between particles or islands of microporous barrier and between the microporous barrier and the meso/microporous structure.

One generic technique for enhancing the selectivity of a sieving membrane is to agglomerate adjacent particles of molecular sieve to reduce or substantially eliminate voids between the particles and between the particles and walls of the pore structure in the meso/macroporous structure. Because the particles are nano-sized and the number of adjacent particles can be relatively few, the agglomeration can occur while still retaining desirable Permeant Flow Rates. For polymeric molecular sieves that are thermoplastic, the agglomeration can occur by heating to a temperature where agglomeration occurs but no so high as to lose either its microporous structure or its ability to provide the desired occlusion of the meso- or macropore of the meso/macroporous structure. Agglomeration can also be accomplished by calcining zeolitic molecular sieves. Calcining tends to agglomerate small zeolite particles, especially particles that are neither silated nor otherwise treated to reduce the tendency to agglomerate. The temperature and duration of the calcining will depend upon the nature of the zeolitic molecular sieve. Usually temperatures of between 450° C. and 650° C. are employed over a period of between 2 and 20 hours.

The agglomeration technique may be used with respect to molecular sieve particles that are on the surface of the meso/macroporous structure as well as those within the pores of the structure. Most preferably, agglomeration is used when the molecular sieve particles are located within the meso- or macropores of the meso/macroporous structure such that the major dimension of the agglomerate is less than 200, preferably less than 100, nanometers. The agglomeration may be effected with or without a pressure differential across the membrane. Preferably a pressure differential is used to assist in reducing voids through which fluid can by-pass the molecular sieve.

Another generic technique where the discontinuous assembly of barrier defines voids is to at least partially occlude at least a portion of the voids by a solid material therein. Preferably the solid material is a polymer or inorganic material. The solid material may simply reside in the void or it may adhere or be bonded to the molecular sieve or meso/macroporous structure. The solid material may be a particle or oligomer that may be preformed and then introduced into the voids or it may be formed in situ.

In one aspect, the solid material provides a "mortar" with the microporous barrier particles. The mortar is typically a suitable polymeric material that can withstand the conditions of the separation. Representative polymers include polysulfones; poly(styrenes) including styrene-containing copolymers; cellulosic polymers and copolymers; polyamides; polyimides; polyethers; polyurethanes; polyesters; acrylic and methacrylic polymers and copolymers; polysulfides, polyolefins, especially vinyl polymers and copolymers; polyallyls; poly(benzimidazole): polyphosphazines; polyhydrazides; polycarbodiides, and the like. Preferred polymers are those having porosity such as PIMs (see WO 2005/012397) and polymers in which porosity has been induced by pore forming agents. These polymers have pores that may be 0.3 or more, preferably at least 1, nanometer in major dimension and hence allow for fluid flow to and from the barrier particles.

It is not necessary that all particles be encased in the mortar. Often the average thickness of the mortar layer is less than 100 nanometers, and is preferably no more than the major dimension of the particles. If too much mortar is used, a mixed membrane structure may result, and flux unduly penalized. Hence, the mass ratio of barrier particles to mortar often is in the range of between 1:2 to 100:1, preferably between 3:1 to 30:1.

The mortar and particles may be admixed, e.g., in a slurry, and then placed in association with the microporous structure, or may be provided after deposition of the particles. The polymer may be formed in situ at the region containing the barrier particles. The barrier particle may be inert to the polymerization or may have active sites to anchor a polymer. For instance, the particle may be functionalized with a reactive group that can bind with the polymer or with monomer undergoing polymerization, say, through a condensation or addition mechanism such as discussed above.

A concern is that the mortar occludes the micropores of the molecular sieve. With highly porous polymer such as the PIMs, the effect of any occlusion can be attenuated. Often, the amount of polymer used for the mortar and its molecular weight and configuration is such that insufficient polymer is present for encapsulating all the molecular sieve particles. Frequently, the mass ratio of polymer to molecular sieve is between 0.01:1 and 0.3:1. The weight average molecular weight of the polymer is sometimes in the range of 20,000 to 500,000, preferably, between 30,000 and 300,000.

The mortar may be other than polymeric. For example, where the molecular sieve is a zeolite, a silicon tetraalkoxide can react with the zeolite and can through hydrolysis form a silica framework or mass between the molecular sieve particles. Usually a dilute aqueous solution of silicon tetraalkoxide is used, e.g., containing between 0.5 and 25 mass percent silicon tetraalkoxide, to assure distribution. The functionalization of the zeolite with silicon tetraalkoxide also is useful as a cross-linking site with organic polymer, especially those containing functional groups such as hydroxyl, amino, anhydride, dianhydride, aldehyde or amic acid groups that can form covalent bonds with organosilicon alkoxide. Also, the same or different zeolite may be grown between the zeolite particles and the zeolite particles and the meso/macroporous structure using the techniques described above.

Yet another approach to reducing bypass is to use two or more sized particles in forming the barrier-containing layer. If, for example, the microporous barrier particles are generally spherical with a nominal major dimension of 60 nanometers, the regions between the particles can be sizable and enable bypass. Incorporating configurationally compatible particles in these regions can hinder fluid flow and thus result in a greater portion of the fluid being directed to the barrier particles for the selective separation. The configuration of the barrier particles will depend upon the type of barrier particle used. A microporous zeolitic molecular sieve particle having a major dimension of less than 100 nanometers will likely have a defined configuration due to its crystalline structure. Some zeolites tend to have a platelet-type configuration whereas others, such as AlPO-14, have a rod-like structure. Similarly, polymeric, ceramic, glass and carbon molecular sieve particles may have configurations that are not readily changed. Hence, the configuration of the open regions between particles can vary widely.

Sometimes, the configurationally compatible particles are selected to achieve at least partial occlusion of the region. Thus, for spherical barrier particles rod shaped or much smaller configurationally compatible particles may be desired. The configurationally compatible particles may be of any suitable composition given the size and conditions of operation. The particles may be polymeric, including oligomeric; carbon; and inorganic such as fumed silica, zeolite, alumina, and the like.

The invention claimed is:

1. An integrated naphtha cracker and naphtha reformer system comprising:

a. a naphtha supply conduit adapted to supply naphtha feedstock;

b. a membrane separator having at least one inlet and containing a selectively permeable membrane having a permeate side and a retentate side, said membrane having a $C_6$ Permeate Flow Index of at least 0.01 and a $C_6$ Permeate Flow Ratio of at least 1.25:1, said membrane separator adapted to provide a permeate on the permeate side that is enriched in normal paraffins as compared to the naphtha feedstock;

c. a naphtha cracker adapted to produce olefin in fluid communication with the permeate side of the membrane; and d. a naphtha reformer adapted to provide a reformate in fluid communication with the retentate side of the membrane.

2. The system of claim 1 in which the membrane is a sieving membrane.

3. The system of claim 2 in which the sieving membrane has a $C_6$ Permeate Flow Index of at least 0.02 and a $C_6$ Permeate Flow Ratio of at least 1.35:1 to 6:1.

4. The system of claim 1 in which intermediate and in fluid flow communication with the membrane separator and the reformer is a hydrotreater adapted to remove sulfur components.

5. An integrated process for converting naphtha feedstock containing normal and non-normal paraffins to olefins and reformate comprising:

a. contacting at said feedstock with a retentate-side of a selectively permeable membrane having a $C_6$ Permeate Flow Index of at least 0.01 and a $C_6$ Permeate Flow Ratio of at least 1.25:1 under conditions including sufficient membrane surface area and pressure differential across the membrane to provide a retentate fraction that has a reduced concentration of normal paraffins, and to provide across the membrane at a permeate-side, a permeate fraction having an increased concentration of normal paraffins;

b. cracking at least a portion of the permeate fraction under cracking conditions to provide an olefin-containing cracker product; and c. reforming at least a portion of the retentate fraction under reforming conditions to provide an aromatic-containing reformate.

6. The process of claim 5 in which the membrane is a sieving membrane.

7. The process of claim 6 in which the sieving membrane has a $C_6$ Permeate Flow Index of at least 0.02 and a $C_6$ Permeate Flow Ratio of at least 1.35:1 to 6:1.

8. The process of claim 5 wherein the naphtha feedstock contains sulfur component and the retentate fraction is subjected to hydrotreating under hydrotreating conditions to remove sulfur component therefrom prior to reforming.

9. The process of claim 8 wherein the sulfur component permeates the sieving membrane and the concentration of sulfur component in the permeate fraction is greater than the concentration of sulfur component in the retentate fraction.

10. The process of claim 5 wherein the concentration of normal paraffin in the permeate fraction is between 40 and 80 mass-%.

* * * * *